United States Patent [19]

Francia

[11] Patent Number: 4,924,687

[45] Date of Patent: May 15, 1990

[54] QUICK RELEASE THREAD ROLL SUPPORT

[75] Inventor: Paul P. Francia, Rochester, N.Y.

[73] Assignee: C. J. Winter Machine Works, Inc., Rochester, N.Y.

[21] Appl. No.: 421,947

[22] Filed: Oct. 16, 1989

[51] Int. Cl.[5] ..... B21H 3/04

[52] U.S. Cl. ..... 72/102; 72/104

[58] Field of Search ..... 72/67, 80, 102, 103, 72/104, 108, 118, 120, 121

[56] References Cited

U.S. PATENT DOCUMENTS

| | | | |
|---|---|---|---|
| 2,576,709 | 11/1951 | Affleck | 72/104 |
| 2,595,383 | 5/1952 | Irving | 72/102 |
| 3,774,432 | 11/1973 | Bedker | 72/103 |
| 4,050,276 | 9/1977 | Habegger | 72/104 |

*Primary Examiner*—Lowell A. Larson

*Attorney, Agent, or Firm*—Shlesinger Fitzsimmons Shlesinger

[57] ABSTRACT

An annular threading roll is releasably secured to one end of a support shaft by a ball detent which in its locking position seats at one side in a semi-spherically shaped recess that is formed in the inner peripheral surface of the roll, and which is engaged at its opposite side by an enlarged-diameter head formed on one end of an operating member that is mounted for limited axial movement in an axial bore in the shaft. The operating member is spring-loaded into a position in which its head engages the detent to keep the latter in its roll locking position, but the member can be pushed axially to a second position to remove its head from behind the detent which can then shift radially inwardly of the shaft to release the roll for axial movement off of the shaft.

8 Claims, 1 Drawing Sheet

QUICK RELEASE THREAD ROLL SUPPORT

BACKGROUND OF THE INVENTION

This invention relates to multiple spindle screw thread machines, and more particularly to improved apparatus for releasably mounting threading rolls on the outboard attachments to the machine. More specifically, this invention relates to a device for releasably and reversibly securing a threading roll on its rotatable support shaft, which is carried in the usual manner by a thread roll supporting arm.

The U.S. Pat. No. 4,617,816, which is owned by the same company to which this application has been assigned, discloses a thread rolling attachment of the type with which this invention is generally concerned. An attachment of the type disclosed in the above-noted patent includes a pair of thread roll supporting arms, which are pivotally mounted intermediate their ends on a yoke, to be forced into rolling engagement with opposite sides of a piece of rotating bar stock in order to form threads in the stock. The arms are actuated by a wedge element which is manipulated by a fluid pressure operated piston.

Typically threading rolls of the type described are subjected to an enormous amount of pressure when they are forced against diametrally opposite sides of the rotating bar stock in order to form a pattern, such as threads, in the peripheral surface of the stock. For example, it heretofore has been customary releasably to secure a threading roll of the type described to one end of a rotatable shaft, which is mounted for rotation in a bore located in the outer of the pivotally mounted roll supporting arm. However, the means heretofore employed for removably securing the roll to the shaft has been such that it normally is a rather time-consuming operation to mount a threading roll upon, or to remove it from, its supporting shaft. Moreover, such mounting means has not enabled one readily to reverse the position of the threading roll on the shaft in order to maximize use of the roll.

Accordingly, it is an object of this invention to provide improved means for releasably securing a threading roll on the supporting shaft carried by a roll supporting arm in a screw machine outboard attachment of the type described.

Still another object of this invention is to provide relatively simple and inexpensive means for quickly and easily a threading roll onto or removing it from a roll supporting shaft of the type described.

Other objects of the invention will be apparent hereinafter from the specification and from the recital of the appended claims, particularly when read in conjunction with the accompanying drawing.

SUMMARY OF THE INVENTION

Each of the thread roll supporting arms in an outboard attachment for a multiple spindle screw machine carries in its outer end a rotatable, thread roll supporting shaft which projects axially at one end beyond one side of the supporting arm, and slidably and coaxially into the bore of a thread roll. Each thread roll is secured releasably against axial movement on the projecting end of its associated shaft by means of a spherical ball detent, which at one diametral side thereof seats removably in an semi-spherical recess in the inner peripheral surface of the thread roll, and which projects at is opposite side into a registering bore formed radially through the supporting shaft adjacent its projecting end. Mounted for limited axial movement in an axial bore in the shaft is a spring-loaded operating rod, which has at one end thereof a cylindrically shaped portion that projects slidably into the radial bore containing the ball detent.

Normally the cylindrical shaped portion of the operating rod is resiliently retained in an operating position in which its outer peripheral surface engages and urges the ball detent into the registering recess in the inner peripheral surface of the thread roll, thereby securing the thread roll releasably to the projecting end of the supporting shaft. However, at its end remote from its ball engaging end, the operating rod is adapted to be urged manually and axially against the resistance of a spring in a direction to cause the ball-engaging end of the rod to be shifted axially out of the projecting end of the shaft, and for a distance sufficient to permit a reduced-diameter, tapered surface on the operating rod to register with the ball detent. This permits the ball detent to shift radially inwardly of the supporting shaft, and to be disengaged from the recess in the thread roll, which can then be slid axially off of the shaft to be reversed or replaced. When pressure on the operating rod is released the spring returns the rod to its operating position.

THE DRAWING

DETAILED DESCRIPTION OF THE PREFERRED EMBODIMENTS

Figure 1:
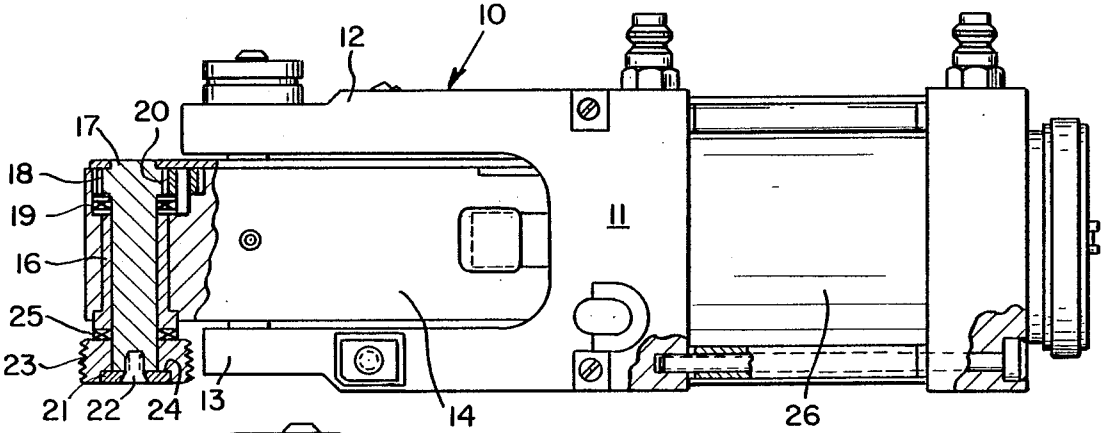
FIG. 1 PRIOR ART
FIG. 1 is a plan view of part of a conventional outboard attachment for a screw machine of the type described, the roll supporting arm and mounting means for the thread roll being partially broken away and shown in section for purposes of illustration.

Referring now to the drawings by numerals of reference, and first to FIG. 1, 10 denotes generally part of a conventional thread rolling attachment of the type disclosed in the above-noted U.S. Pat. No. 4,617,816. This portion 10 of the attachment includes a conventional yoke 11 having a pair of spaced, integral arms 12 and 13 between which is pivotally mounted in the usual manner a thread roll supporting arm 14. Secured in a bore in the outer end of arm 14 with its axis extending parallel to the pivotal axis of arm 14 is an annular roll arm bushing 16. Mounted to rotate intermediate ends in the bushing 16 coaxially thereof is a roll support shaft 17, which at one end (its upper end in FIG. 1) has thereon a spur gear 18 that rotates in a counterbore in arm 14 on a thrust bearing 19. The teeth of gear 18 mesh with the teeth of an idler gear 20, which is mounted in the usual manner in the upper end of the arm 14 adjacent the spur gear 18.

At its opposite end (its lower end in FIG. 1) the shaft 17 projects beyond the lower end of the bearing 16 and has fastened thereon by a plate 21 and screw 22 a conventional thread roll 23. As shown in FIG. 1, the thread roll 23 has formed in its lower end a counterbore 24 for accommodating the circular mounting plate 21. Screw 22 secures plate 21 coaxially against the lower end of shaft 17 in such manner that the plate overlaps the bottom of the counterbore 24 in order to secure the roll 23 against another thrust bearing 25, which is interposed between the thread roll 23 and the lower end of bearing 16.

As will be apparent by reference to the above-noted U.S. Pat. No. 4,617,816, a fluid pressure cylinder 26 is attached to the rear of the yoke 11 for use in effecting the operation of the tread rolling attachment. Since the actual operation of the attachment forms no part of this invention, the cylinder 26 and its associated controls will not be illustrated or described in further detail herein. However, since the portion of the pattern on the outer end of roll 23 tends to wear more rapidly than the portion on its inner end, it is desirable that roll 23 be reversibly mounted on shaft 17. This could be done by forming in each end of the roll 23 a counterbore such as denoted at 24 in FIG. 1, but then this would tend significantly to reduce the support contact area between the thread roll internal diameter, and the shaft 17 upon which it is mounted.

Figure 4:
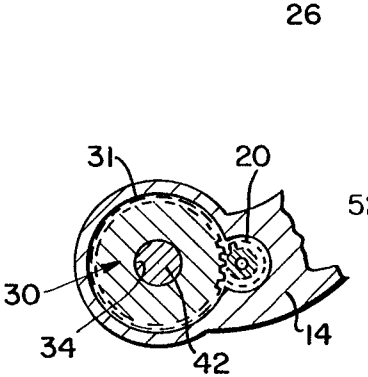
FIG. 4 is a fragmentary sectional view taken generally along the line 4—4 in FIG. 2 looking in the direction of the arrows.
Figure 3:
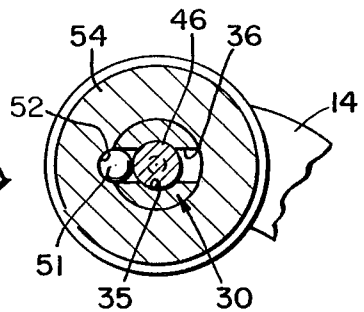
FIG. 3 is a fragmentary sectional view taken generally along the line 3—3 in FIG. 2 looking in the direction of the arrows.
Figure 2:
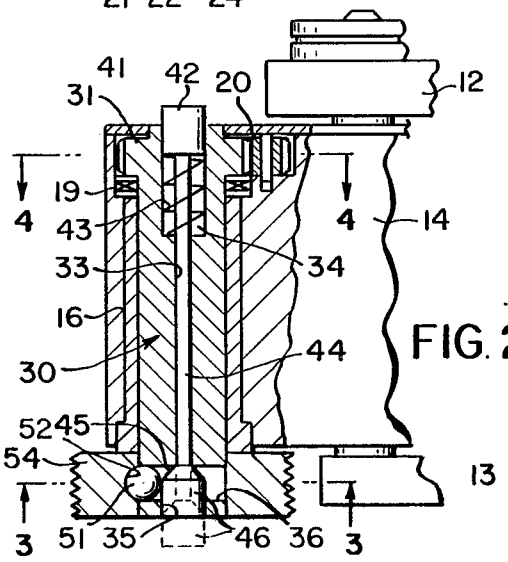
FIG. 2 is an enlarged, fragmentary plan view generally similar to that shown in FIG. 1, but illustrating a quick release thread roll supporting device made according to one embodiment of this invention.

Referring now to the invention as illustrated in FIGS. 2 to 4, wherein like numerals are employed to denote elements similar to those illustrated in FIG. 1, 30 denotes generally a modified thread roll supporting shaft having formed on one end thereof (the upper end in FIG. 2), the usual spur gear 31, which meshes with an idler gear 20 in a manner similar to that of the mechanism illustrated in FIG. 1. Shaft 30 differs from shaft 17 (FIG. 1) primarily in that it has extending coaxially therethrough an axial bore 33 having at opposite ends thereof enlarged-diameter counterbores 34 and 35, respectively. As the shaft 30 is illustrated in FIG. 2, the counterbore 34 is formed in its upper end, while the counterbore 35 is formed in its lower end. Moreover, shaft 30 also has formed therethrough adjacent its lower end a radially extending port or bore 36, which opens at opposite ends, respectively, on the outer peripheral surface of shaft 30, and which intersects intermediate its ends the counterbore 35.

Mounted for limited axial movement in the shaft 30 coaxially thereof is a spring-loaded operating rod which is denoted generally by numeral 41. At its upper end, as illustrated in FIG. 2, rod 41 has an enlarged-diameter head portion 42, which is mounted for sliding, coaxial movement in the counterbore 34. Head 42 is engaged at its inner end by a compression spring 43, which is mounted in the counterbore 34 to surround rod 41 between the bottom of the counterbore and the head 42 on the rod. Integral with the projecting coaxially from the inner end of the heat 42, and slidably downwardly and coaxially through the bore 33 in the shaft, is a reduced-diameter stem portion 44 of the rod 41. The stem portion 44 of the rod is connected adjacent its lower end by a truncated-conical section 45 with another, enlarged-diameter, cylindrically shaped head portion 46 which is mounted to slide coaxially in the counterbore 35. Normally the spring 43 retains rod 41 in the operating position as illustrated in FIG. 2, wherein the truncated-conical portion 45 of the rod is engaged at its upper end with the bottom of the bore 33 in shaft 30, whereby the head portion 46 on the rod projects transversely into the radial bore 36 in shaft 30.

When the operating rod 41 is disposed in the position as shown in FIG. 2, the outer peripheral surface of its head portion 46 engages one diametral side of a spherically shaped ball detent 51, which has a diameter approximately equal to the diameter of the radial bore 36, and which is mounted for limited radial movement in this bore. Detent 51, when held in the position as shown in FIG. 2, is releasably seated at the diametral opposite side thereof remote from the head 46 in a registering, semi-spherical recess 52, which is formed in the inner peripheral surface of an annular thread roll 54. Roll 54 is thus held releasably by the detent 51 on the lower end of the support shaft 30, where in turn is drivingly connected to the roll 54 by detent 51.

In order to release the thread roll 54 from the shaft 30, as illustrated in FIG. 2, one need only to urge the rod 41 axially downwardly against the resistance of spring 43, and for a distance sufficient to cause the lower head portion 46 to be shifted axially downwardly into the detent releasing position as shown by broken lines in FIG. 2. In this position the detent 51 now registers laterally with the reduced-diameter stem portion 44 of the rod 41, thus permitting the ball detent 51 to roll or otherwise be urged radially inwardly in the bore 36 to a released position in which it is completely withdrawn from the recess 52 in the thread roll 54, thereby permitting the thread roll 54 to be withdrawn axially downwardly and off of the shaft 30. Obviously the roll 54 could then be replaced by a substitute roll 54, or alternatively, the roll 54 could be reversed and then be replaced onto the shaft 30, after which the rod 41 would be released in order to permit the head portion 46 of the rod to return the ball detent 51 into its latching or securing position relative to the thread roll 54.

From the foregoing it will be apparent that the present invention provides relatively simple and inexpensive means for releasably securing a thread roll 54 to an associated supporting shaft 30, and in such manner as to permit quick replacement of the thread roll, or to permit it quickly to be reversed and resecured to the projecting end of the supporting shaft 30. The operation requires no tools, and eliminates or avoids the need for forming a countersink, such as a countersink 24 in FIG. 1, in each side of a thread roll, if one were to design the thread roll 23 in FIG. 1 for reversible mounting. In such case, as noted above, the formation of a counterbore in each end of the thread roll 23 would considerably reduce the amount of surface area available for supporting the roll during use. With the novel invention disclosed herein, however, there is absolutely no need for providing any counterbore in either end of the thread roll 54.

While this invention has been illustrated and described in connection with a thread roll 54 having a single semi-spherical recess 52 in its inner periphery, it will be apparent that additional such recesses may be employed provided they are angularly spaced from each other, and that the attachment also could be mounted on a machine other than a screw machine, such as for example, on a lathe. Moreover, it will be apparent that this invention applies equally as well to other types of pattern rolls which could be used for rolling different patterns on bar stock. Also, while only certain embodiments have been described in detail, it will be apparent that this invention is capable of still further modification, and that this application is intended to cover any such modifications as may fall within the scope of one skilled in the art, or the appended claims.

I claim:

1. In a thread rolling attachment for an automatic screw machine having thereon a pivotal roll supporting arm, improved means for rotatably supporting a pattern roll on one end of said arm, comprising a shaft rotatably mounted in a bore which is formed in one end of said arm to extend transversely between opposite sides thereof, said shaft projecting at one end thereof beyond one side of said arm, an annular pattern roll surrounding said one end of said shaft coaxially thereof, and having in its inner peripheral surface a recess which registers with a recess formed in the periphery of said one end of said shaft, and quick release means releasably securing said roll in a predetermined axial position on said one end of said shaft, said quick release means comprising a detent mounted between said recesses for limited radial movement relative to said roll and said one end of said shaft, and a detent operating member mounted adjacent said detent for movement between a first position in which said member retains said detent in a locking position in which first and second portions of said detent project, respectively, into said recess in said roll and into said recess in said shaft, and a second position in which said detent is free to shift radially inwardly of one of said recesses thereby to withdraw from the other of said recesses and to permit removal of said roll axially off of said shaft.

2. In a thread rolling attachment as defined in claim 1, wherein said recess in said shaft forms part of a radial port formed in said shaft to open at one end on the periphery of said shaft and at its opposite end on a bore formed in said one end of the shaft parallel to the axis of said shaft, said detent is mounted for limited radial movement in said port during movement thereof into and out of its locking position, and said operating member is mounted in said bore in said shaft adjustment between said first position in which said member urges said detent radially outwardly in said port to engage said first portion of said detent in said recess in said roll, and said second position in which said member permits said detent to shift radially inwardly of said port to disengage said first portion of said detent from said recess in said roll.

3. In a thread rolling attachment as defined in claim 2, including means supporting said operating member for limited axial movement in said bore in said shaft, said supporting means including spring means normally urging said member resiliently into said first position.

4. In a thread rolling attachment as defined in claim 3, wherein said bore in said shaft is an axial bore which extends coaxially through said shaft, said operating member is mounted intermediate its ends for limited, axial sliding movement coaxially of said bore, and projects at one end thereof beyond one end of said axial bore when disposed in said first position.

5. In a thread rolling attachment as defined in claim 4, wherein said operating member has intermediate its ends a reduced diameter stem portion axially slidable in said axial bore, and has formed on the opposite end thereof an enlarged-diameter head portion axially slidable in a counterbore in the opposite end of said axial bore, said detent is a ball detent engagable selectively by said stem portion and head portion, respectively, of said member, and said recess in said roll is semi-spherical in configuration.

6. In a pattern rolling attachment for a machine having thereon a pivotal arm for supporting a pattern roll in engagement with a piece of rotating stock, improved means for rotatably supporting a pattern roll on one end of said arm, comprising a shaft rotatably mounted in a bore which is formed in one end of said arm to extend transversely between opposite sides thereof, said shaft projecting at one end thereof beyond one side of said arm, an annular pattern roll surrounding said one end of said shaft coaxially thereof, and having in its inner peripheral surface a recess which register with a recess formed in the periphery of said one end of said shaft, and means releasably mounting said roll on said one end of said shaft for rotation therewith, said mounting means comprising a detent interposed between said roll and said shaft, and quick release means on said shaft engaging said detent and movable between a locking position in which first and second portions of said detent extend, respectively, into said recess in said roll and into said recess in said shaft, thereby releasably to secure said roll on said one end of said shaft, and a release position in which said first portion of said detent is withdrawn from said recess in said roll, thereby to permit removal of said roll from said shaft.

7. In a pattern rolling attachment as defined in claim 6, wherein said detent is generally spherical in configuration, said recess in said roll is generally semi-spherical in configuration, and said detent is movable radially in said recess in said shaft selectively to engage said first portion of said detent in said recess in said roll.

8. In a pattern rolling attachment as defined in claim 7, wherein said mounting means further includes spring means resiliently retaining said quick release means in said locking position.

* * * * *